United States Patent [19]

Blomberg et al.

[11] Patent Number: 4,691,529

[45] Date of Patent: Sep. 8, 1987

[54] ABSORPTION REFRIGERATOR FOR ICE-MAKING

[75] Inventors: Peter E. Blomberg, Stockholm; Sven A. Gurt, Solna, both of Sweden

[73] Assignee: AB Electrolux, Stockholm, Sweden

[21] Appl. No.: 916,956

[22] Filed: Oct. 8, 1986

[30] Foreign Application Priority Data

Oct. 23, 1985 [SE] Sweden ..... 8504995

[51] Int. Cl.[4] ..... F25B 25/02

[52] U.S. Cl. ..... 62/332; 62/340

[58] Field of Search ..... 62/340, 332

[56] References Cited

U.S. PATENT DOCUMENTS 2,181,224 11/1939 Widell ..... 62/332 X 3,028,733 4/1962 Mateski ..... 62/135

3,824,804 7/1974 Sandmark ..... 62/335 X

*Primary Examiner*—William E. Tapolcai

*Attorney, Agent, or Firm*—Alfred E. Miller

[57] ABSTRACT

A refrigerator is provided with a freezing chamber (16) which is cooled by the evaporator (24) of an absorption refrigerating apparatus. A machine (44) for automatic making and emitting of pieces (46) of ice is located in the freezing chamber (16). The machine (44) is cooled by the evaporator (36) of a compression refrigerating apparatus. When the machine (44) has produced the pieces (46) of ice, the evaporator (24) of the absorption refrigerating apparatus (22) keeps the pieces of ice frozen.

3 Claims, 3 Drawing Figures

ABSORPTION REFRIGERATOR FOR ICE-MAKING

The invention refers to a refrigerator showing a freezing chamber which is arranged to be kept at freezing temperature by an evaporator of an absorption refrigerating apparatus, the operation of which being independent of other refrigerating apparatuses.

If water is frozen to pieces of ice in the freezing chamber of a refrigerator operated by an absorption refrigerating apparatus, the freezing will take a relatively long time.

The object of the invention is to bring about a refrigerator of the kind introductorily set forth, where pieces of ice can be produced relatively quick and automatically.

This object is reached by the refrigerator according to the invention by a machine known per se for automatic making and emitting of pieces of ice, the machine being located in the freezing chamber and being arranged to be refrigerated by an evaporator of a compression refrigerating apparatus.

According to a further development of the invention the freezing chamber is divided into two compartments by a heat conductive wall, the machine for ice-making being located in one of the compartments and the evaporator of the absorption refrigerating apparatus being located at the wall in heat conductive contact with the wall. By this, food-stuffs which suitably are stored in the other compartment, are prevented from falling into the ice-making machine and disturb it, simultaneously as the evaporator of the absorption refrigerating apparatus can take up heat from both compartments, so that these are cooled simultaneously.

Figure 2:
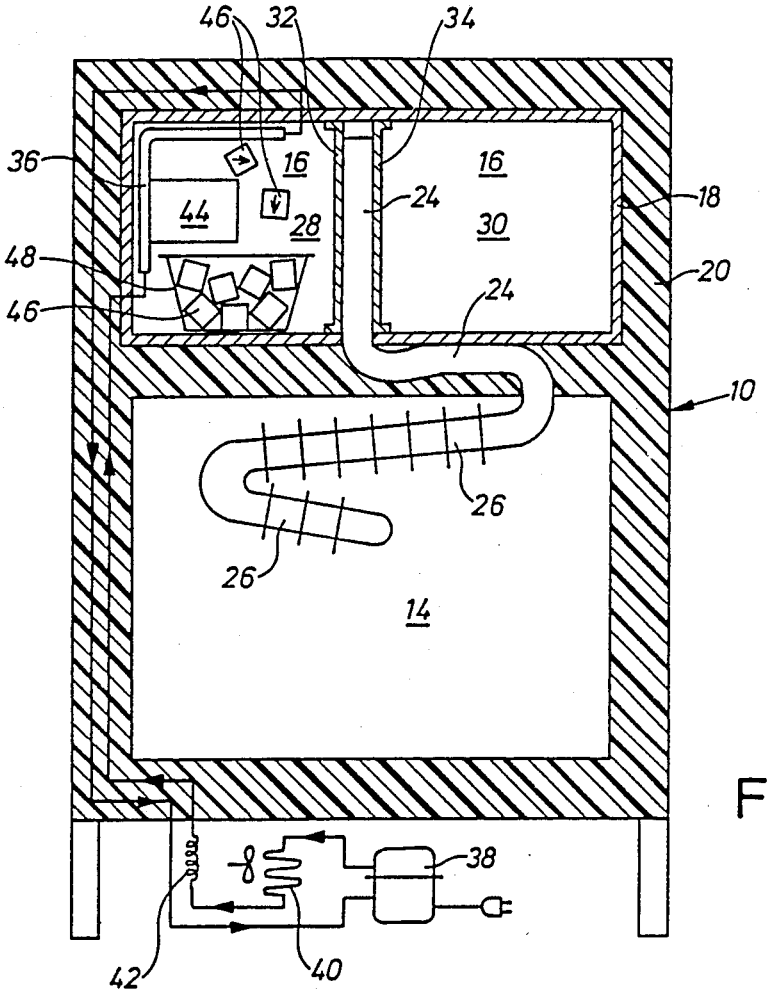
Figure 1:
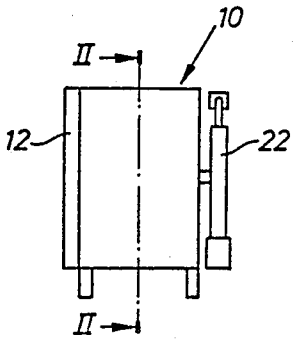
Figure 3:
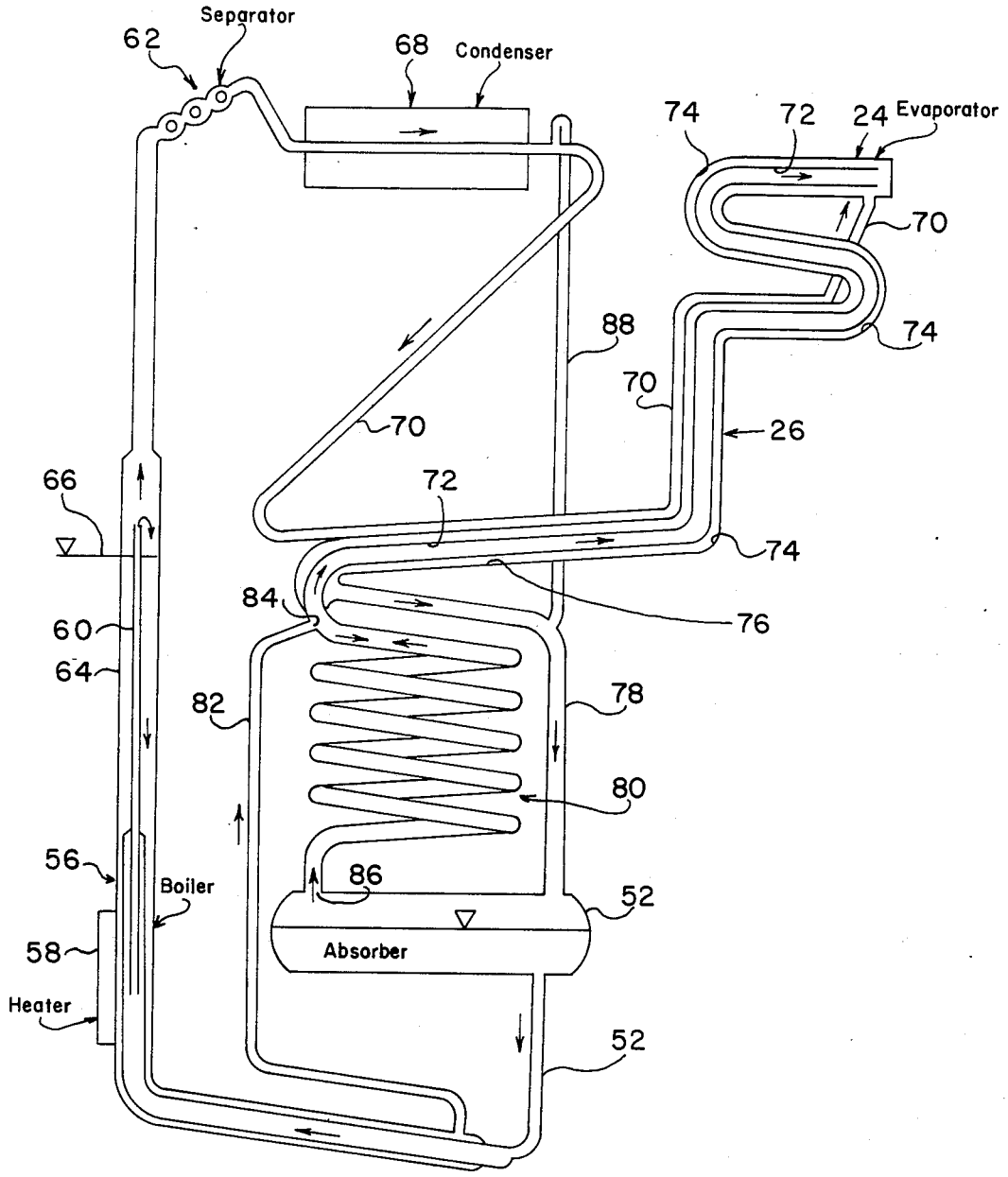

A refrigerator according to the invention will be described below with reference to the accompanying drawings, in which FIG. 1 shows a side view of the refrigerator and FIG. 2 shows an enlarged sectional view according to the marking II—II in FIG. 1 and FIG. 3 shows an absorption refrigerating apparatus of the type used in the arrangement shown in FIG. 1.

Numeral 10 designates a refrigerator provided with a door 12 and showing a cooling chamber 14 and a freezing chamber 16. The freezing chamber 16 is surrounded by a heat conductive lining 18 made of aluminium, the lining 18 being surrounded by the insulation 20 of the refrigerator.

The refrigerator is operated by an absorption refrigerating apparatus 22, which can be of a kind known per se, e.g. according to U.S. Pat. No. 4,458,504, the colder part 24 (part 18 in said patent) of the evaporator being in heat conductive communication with the freezing chamber 16, and the warmer part 26 (part 19 in said patent) being in heat conductive communication with the cooling chamber 14.

The chamber 16 is divided into two compartments 28 and 30 by two heat conductive walls 32 and 34 being in heat conductive contact with the evaporator part 24 which is located between the walls 32 and 34. The compartment 30 can, e.g., be used for storing food-stuffs in a frozen state.

The evaporator 36 of a compression refrigerating apparatus is arranged in the compartment 28. The compression refrigerating apparatus is constituted by a conventional refrigerant circuit comprising a compressor 38, a condenser 40, a capillary pipe 42 and the evaporator 36. The evaporator 36 is in heat conductive contact with a machine 44 for automatic making and emitting of pieces of ice. The machine is automatically fed with water from conduits and valves not shown. Such machines, so-called ice makers, are generally known. An example of such a machine is described in the U.S. Pat. No. 3.028,733. The pieces 46 of ice made by the machine 44 are collected in a tray 48.

The refrigerator is suitable to use in a trailer or motor home. Before departure with the trailer, the absorption refrigerating apparatus 22 is started. Simultaneously, the compressor 38 and the ice-maker 44 are started by their electric operating means being connected to the electric mains. The machine 44 now commences, cooled by the evaporator 36, to produce pieces of ice which are collected in the tray 48. The evaporator 36 simultaneously helps to cool the evaporator 24, through which the cooling down of the cooling chamber 14 to its operating temperature will be speeded up. When the freezing compartment 30 and the cooling chamber 14 are sufficiently cooled down and a sufficient number of pieces of ice has been produced by the machine 44, the compartment 30 and the chamber 14 can be filled with goods. The compressor 38 and the machine 44 are stopped by being disconnected from the electric mains. The trip with the trailer or motor home can begin, the refrigerator now being solely cooled by the absorption refrigerating apparatus 22 which can be operated by gas or by electricity from the generator of the towing car. Now, the absorption refrigerating apparatus itself keeps the pieces of ice in the tray 48 frozen.

The evaporator parts 24 and 26 can also constitute parts of the absorption refrigerating apparatus shown in FIG. 3. Said apparatus, which is known per se, will be described hereinafter.

The numeral 52 designates an absorber vessel containing an absorption liquid, such as water, in which a refrigerant, such as ammonia, is dissolved. This solution, which is relatively rich in refrigerant, is called a rich solution. The rich solution exits from the absorber vessel 52 through a conduit 54 and enters a boiler 56 in which the rich solution is supplied with heat from a heater 58 operable by gas or electricity. The refrigerant vapor boils off from the rich solution which becomes impoverished in refrigerant thereby causing a so-called weak solution. The mixture of refrigerant vapor and weak solution is expelled through a pump pipe 60, the refrigerant vapor continuing on a separator 62 which separates out absorption liquid accompanying the refrigerant vapor and the weak solution being collected in an outer pipe 64 of the boiler to a certain level 66.

The refrigerant vapor flows from the separator 62 into a condenser 68, where heat is transferred from the vapor to the surroundings of the condenser so that the vapor condenses. The refrigerant condensate leaves the condenser through a conduit 70 and enters the evaporator part 24, where the condensate meets a flow of an inert gas, such as hydrogen gas, and is vaporized in an outer pipe 74 in the inert gas during absorption of heat from the surroundings of the evaporator parts 24 and 26. The inert gas is supplied to the evaporator part 24 through an inner pipe 72 which is located within the outer pipe 74 and the mixture of inert gas and vaporized refrigerant exits from the evaporator parts 24 and 26 through an outer pipe 76, which is a continuation of the pipe 74. The pipe 76 leads to the absorber vessel 52 via a conduit 78.

From the absorber vessel 52, the mixture of refrigerant vapor and inert gas is elevated through the absorber 80 and meets the weak solution, which, driven by the level 66, comes from the pipe 64 via a conduit 82 into the upper part of the absorber 80 at 84. While flowing downwards through the absorber 80 the weak solution absorbs refrigerant vapor flowing upwards during rejecting of heat to the surroundings of the absorber, the weak solution thereby becoming a rich solution again before it flows down into the absorber vessel 52 at 86. The elevating inert gas continues from the absorber 80 to the pipe 72 and enters after that into the evaporator 24, 26 and permits the refrigerant condensate to vaporize in it.

In order to prevent refrigerant vapor, which possibly does not condensate into the condenser, from collecting in the condenser and blocking the outflow of refrigerant condensate from the condenser, a vent conduit 88 is arranged between the outlet of the condenser 68 and the conduit 78, which vent conduit leads gaseous medium to the absorber vessel 52.

What is claimed is:

1. In a refrigerator having a compression-type refrigerating apparatus provided with an evaporator and an absorption-type refrigerating apparatus provided with an evaporator, a refrigerating chamber, the improvement comprising: two spaced freezer chambers, a heat conducting wall for each freezing chamber, the evaporator of said absorption refrigerating apparatus having the colder part in said space between said freezer chambers and in contact with said heat conducting walls, the warmer part of said evaporator being in said refrigerating chamber, said compression-type refrigerating apparatus having its evaporator operatively connected to one of said freezer chambers, and said absorption-type refrigerating apparatus being operated independent of the operation of said compression-type refrigerating apparatus.

2. A refrigerator as claimed in claim 1 further comprising an ice making machine in said one freezing chamber having the evaporator of said compression-type refrigerating apparatus therein.

3. A refrigerator as claimed in claim 2 wherein said ice making machine automatically makes and emits ice pieces.

* * * * *